US007724201B2

(12) United States Patent
Nysen et al.

(10) Patent No.: US 7,724,201 B2
(45) Date of Patent: May 25, 2010

(54) COMPACT DIVERSITY ANTENNA SYSTEM

(75) Inventors: Paul Nysen, Carlsbad, CA (US); Geoff Schulteis, Vista, CA (US)

(73) Assignee: Sierra Wireless, Inc., Richmond, British Columbia (CA)

( * ) Notice: Subject to any disclaimer, the term of this patent is extended or adjusted under 35 U.S.C. 154(b) by 88 days.

(21) Appl. No.: 12/031,888

(22) Filed: Feb. 15, 2008

(65) Prior Publication Data

US 2009/0207092 A1 Aug. 20, 2009

(51) Int. Cl.
*H01Q 9/16* (2006.01)

(52) U.S. Cl. ..... 343/821; 343/795; 343/820; 343/700 MS

(58) Field of Classification Search ..... 343/700 MS, 343/795, 820, 821
See application file for complete search history.

(56) References Cited

U.S. PATENT DOCUMENTS

| | | | | |
|---|---|---|---|---|
| 4,513,292 | A * | 4/1985 | Bowman | 343/795 |
| 4,825,220 | A * | 4/1989 | Edward et al. | 343/795 |
| 5,532,708 | A | 7/1996 | Krenz et al. | |
| 5,532,709 | A | 7/1996 | Talty | |
| 5,554,996 | A | 9/1996 | Chatzipetros | |
| 6,323,820 | B1 * | 11/2001 | Haunberger | 343/793 |
| 6,549,170 | B1 | 4/2003 | Kuo et al. | |
| 6,624,790 | B1 | 9/2003 | Wong et al. | |
| 6,674,340 | B2 * | 1/2004 | Quan et al. | 333/164 |
| 6,791,498 | B2 | 9/2004 | Boyle et al. | |
| 6,864,852 | B2 | 3/2005 | Chiang, et al. | |
| 6,888,504 | B2 | 5/2005 | Chiang et al. | |
| 7,088,306 | B2 | 8/2006 | Chiang et al. | |
| 7,095,382 | B2 * | 8/2006 | Surducan et al. | 343/793 |
| 7,098,863 | B2 * | 8/2006 | Bancroft | 343/859 |
| 7,138,952 | B2 | 11/2006 | Mcgrath et al. | |
| 7,215,296 | B2 | 5/2007 | Abramov et al. | |
| 7,298,345 | B2 * | 11/2007 | Rankin | 343/820 |
| 2007/0164920 | A1 | 7/2007 | Chen | |

FOREIGN PATENT DOCUMENTS

| | | |
|---|---|---|
| EP | 0 474 490 | 3/1992 |
| EP | 1 148 584 | 10/2001 |
| GB | 2 422 723 | 8/2006 |

* cited by examiner

*Primary Examiner*—Hoang V Nguyen
(74) *Attorney, Agent, or Firm*—Patterson & Sheridan, L.L.P.

(57) ABSTRACT

The present invention provides a compact antenna system having multiple antennas exhibiting polarization and pattern diversity. The system comprises at least two antennas which may have different polarizations, operatively coupled to a passive element which operates as a Balun for a first antenna and which is configured to absorb and re-radiate electromagnetic radiation from the second antenna to produce a desired radiation pattern. The present invention also provides for additional antennas operatively coupled to the passive element or to the first antenna to provide additional diversity.

25 Claims, 6 Drawing Sheets

COMPACT DIVERSITY ANTENNA SYSTEM

FIELD OF THE INVENTION

The present invention pertains in general to antenna systems and in particular to compact antenna systems having multiple antennas.

BACKGROUND

In radio communications, compact antenna systems are desirable for reasons such as portability, cost, and ease of manufacture. Interest in compact antenna systems has been further stimulated by the use of higher radio frequencies, for example UHF and higher, which allow for antenna lengths significantly less than 1 centimeter, and by the development of lithographic techniques which allow for antenna systems to be printed directly onto circuit boards with small form factors at low cost. However, due to other limitations, such as limited energy sources, regulations limiting the field strength of radio frequency activity, and limitations on energy flow in radio systems of compact size, such antenna systems are often highly complex if they are to achieve high bandwidth requirements of many radio systems. This complexity often results in a large number of precisely manufactured components, making it challenging to provide an antenna system that is both compact and exhibits the performance required of modern radio systems.

An important factor affecting the performance of an antenna system is the tendency for radio communication to be degraded by undesirable interference. For example, electromagnetic radiation from an antenna may reach its destination through multiple paths, as it is reflected off various surfaces in the environment. Since these paths are of different lengths, electromagnetic radiation due to each path may exhibit destructive interference at the destination, a phenomenon known as multipath interference. One method to combat multipath interference is to transmit or receive over multiple channels using multiple antennas, a strategy known as antenna diversity. Typically, the best channel is then used for communication, thereby increasing performance.

Two well-known methods in the art for providing antenna diversity are known as polarization diversity and pattern diversity. Polarization diversity uses multiple antennas with different, for example perpendicular, polarizations to transmit or receive radio frequency energy. Pattern diversity uses multiple antennas, each having a unique radiation pattern, to transmit or receive radio frequency energy. One technique for controlling the radiation pattern of a particular antenna is to locate passive, or parasitic, elements at specific locations and orientations relative to the antenna. The passive elements absorb and re-radiate electromagnetic energy, acting to reflect, direct, or otherwise shape or focus the antenna radiation pattern in a desired fashion.

Traditional approaches to providing polarization and pattern diversity require antenna systems with multiple, independent antennas, which require additional space and detract from compactness. Moreover, to satisfy performance requirements of each antenna, additional structures, for example Reflectors, Directors, and Baluns, are typically provided to facilitate adequate operation of each antenna. This can pose a problem in designing an antenna system that simultaneously satisfies both compactness and performance requirements.

There are several examples of prior art that attempt to provide antenna diversity while retaining compactness of the antenna system. For example, U.S. Pat. No. 5,532,708 discloses a single compact antenna element comprising a "U" shaped body topped with a split crosspiece. The structure can be used in two modes. By supplying radio frequency (RF) energy to the bottom of the "U" shaped body, the structure can be made to behave as a monopole with a vertical polarization; by grounding the bottom of the "U" shaped body and energizing the crosspiece with RF energy, the structure can be made to behave as a dipole with a horizontal polarization, supported by a Balun structure which enhances antenna performance by providing isolation between the antenna and its transmission line. The antenna system therefore provides for sequential polarization diversity using few elements. However, since only one mode can be used at a time, the diversity capability of this antenna system is limited.

As another example, U.S. Pat. No. 7,215,296 discloses an antenna system that provides pattern diversity within a compact structure. A number of monopole antennas with the same polarization are arranged on a planar surface around a common reflector body that electromagnetically isolates the antennas from each other while also acting as a reflector for each antenna. Providing a common reflector for all antennas, as opposed to providing a separate reflector for each antenna, reduces the space requirements and manufacturing cost of the antenna system. However, as all antennas have the same polarization, this antenna system does not provide for polarization diversity.

Polarization and pattern diversity are important strategies for achieving performance requirements of many antenna systems. However, standard techniques providing for polarization and pattern diversity may result in an unacceptably large or complex system of antenna elements. Known antenna systems that attempt to provide for antenna diversity in a compact package have significant limitations with regard to antenna diversity. Therefore there is a need for a compact antenna system which can exploit polarization and pattern diversity by providing for multiple, simultaneously operable antenna elements with low complexity and a small number of components.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a compact diversity antenna system. In accordance with an aspect of the present invention, there is provided a multiple antenna system comprising: a first antenna having two radiating bodies; a second antenna; and a passive element operatively coupled to the first antenna, the passive element configured as a Balun for the first antenna, the passive element configured to absorb and re-radiate electromagnetic radiation from the second antenna to produce a desired radiation pattern.

DETAILED DESCRIPTION OF THE INVENTION

Definitions

Figure 1:
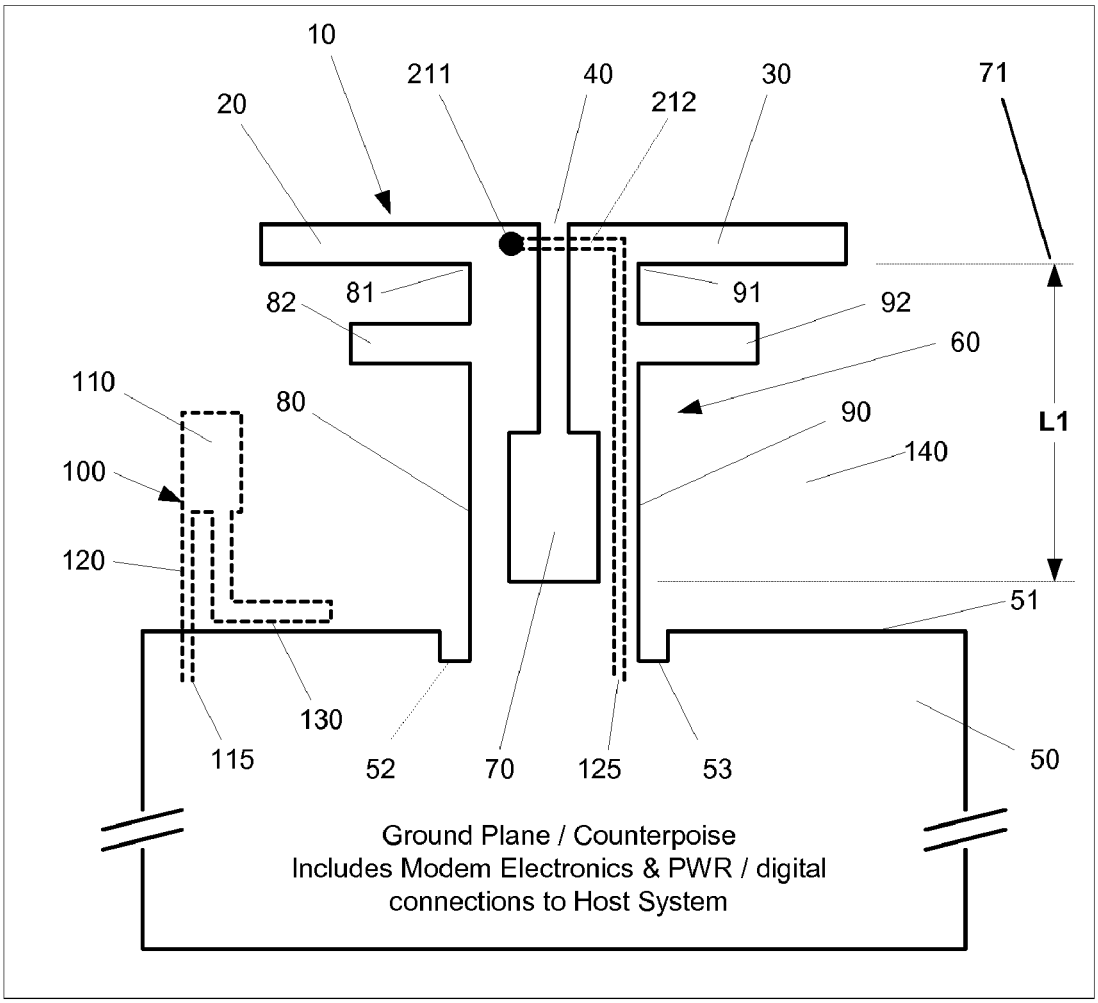
FIG. 1 is a view of one side of a printed circuit board comprising a multiple antenna system according to one embodiment of the present invention.

The terms "antenna" and "radiating body" are used to define a conducting body or arrangement of conducting bodies that radiates an electromagnetic field in response to an alternating voltage across its terminals and the associated alternating electric current, or equivalently a conducting body or arrangement of conducting bodies that produces an alternating voltage across its terminals along with an associated alternating electric current when placed in an electromagnetic field, whenever such a between electromagnetic field and alternating voltage and current is significant to some purpose.

The term "radio frequency transmission line" or "RF transmission line" is used to define an electrically conductive structure for conveying an electrical energy between radio system components, such as an antenna or a modulator/demodulator unit. Each element, mechanism, or device, etc. operatively coupled to such a transmission line can either input or extract electrical energy from the transmission line. For an antenna it is often the case that both functions may occur; for example an antenna may be provided with electrical energy in a transmission mode, and the same antenna may provide electrical energy in a reception mode. For example, three commonly known transmission lines are a coaxial cable, comprising two concentric conducting bodies, a microstrip transmission line, comprising a conductive surface parallel to a wider ground plane, usually lying on opposite sides of a dielectric substrate such as in a printed circuit board, and a stripline transmission line, comprising a conductive surface sandwiched between two ground planes, and separated therefrom by dielectric substrates on each side of the conductive surface. For example, the impedance exhibited by an RF transmission line to other components may be adjusted by impedance matching, for example by distributed matching or by operatively coupling the RF transmission line to additional impedance elements. Impedance matching is commonly performed to optimize signal transmission efficiency. In addition, for example a commonly used standard impedance for transmission lines is 50 Ohms.

The term "Balun" is used to define a passive device or structure that converts between balanced and unbalanced electrical signals. In an antenna system, one purpose of a Balun is to isolate the transmission line from the antenna itself, so that the transmission line does not unintentionally act as an antenna. There are many functional Balun devices known in the art. For example, a centre-tapped transformer or other coupled inductive elements, or a delay-line Balun, comprising transmission lines having length about equal to some odd integer multiple of quarter wavelengths of a given operating frequency. A single quarter wavelength delay-line type Balun can be used for many applications. In some instances, a delay-line Balun may be advantageous for high frequency systems as it may be possible to provide one having a simple, compact structure. In addition, a Balun can also be realised from delay lines shorter than one quarter of a wavelength by substantially increasing the transmission line/delay line gap in the region where the line is closed or shorted. Other manners in which a Balun can be realised would be readily understood by a worker skilled in the art.

The term "passive element" is defined herein as a structure in an antenna system which supports one or more antennas by operating in one or more capacities. Such capacities can include operating as a Balun, or absorbing and re-radiating electromagnetic radiation from an antenna so as to produce a desired radiation pattern. For example wherein the overall radiation pattern, as produced due to operation of one or more antennas and one or more passive elements such as a reflector or director, behaves in an intended manner. For example, the action of a passive element can be considered to be reflecting or scattering electromagnetic radiation. Parasitic elements, for example can be considered types of passive elements.

The term "wave trap" is defined herein as an electrical or electromagnetic filter that blocks passage of a specified class of unwanted electrical or electromagnetic signals. An example of a wave trap is a low-pass filter, which allows signals having a frequency below a given cut-off frequency to pass, while blocking signals having a frequency higher than the cut-off frequency. Other wave traps would be readily understood by a worker skilled in the art.

The term "antenna radiation pattern" is defined as a geometric representation of the relative electric field strength as emitted by a transmitting antenna at different spatial locations. For example, a radiation pattern can be represented pictorially as one or more two-dimensional cross sections of the three-dimensional radiation pattern. Because of the principle of reciprocity, it is known that an antenna has the same radiation pattern when used as a receiving antenna as it does when used as a transmitting antenna. Therefore, the term radiation pattern is understood herein to also apply to a receiving antenna, where it represents the relative amount of electromagnetic coupling between the receiving antenna and an electric field at different spatial locations.

The term "polarization", as it pertain to antennas, is defined herein as a spatial orientation of the electric field produced by a transmitting antenna, or alternatively the spatial orientation of electrical and magnetic fields causing substantially maximal resonance of a receiving antenna. For example, in the absence of reflective surfaces, a simple monopole or dipole transmitting antenna radiates an electric field which is oriented parallel to the radiating bodies of the antenna.

The terms "reactance", "resistance", "inductance", and "capacitance" are defined as characteristics of electrical impedance. In radio design, it is well known that many structures cannot be characterized by a single one of these terms, but may exhibit properties of several. It is understood that when such a term is used herein, it is meant to highlight a property of an electrical structure, without excluding the possibility that other properties may be present.

The terms "ground plane" and "counterpoise" is used to refer to electrical structures supporting electronic elements such as transmission lines and antennas. A ground plane is generally a structure which enables operation of an antenna or transmission line by providing an electromagnetic reference having desirable properties such as absorption and re-radiation, reflection, or scattering of electromagnetic radiation over a prespecified frequency range. In a printed circuit board, a ground plane may possibly comprise a layer of conductive material covering a substantial portion of the printed circuit board. A counterpoise, as generally defined in antenna systems, can be a structure which is used as a substitute for a ground plane, for example having a smaller size than an equivalent ground plane but with a strategically designed structure which enables the counterpoise to effectively emulate such a ground plane. For example, a counterpoise can be regarded as a type of ground plane.

As used herein, the term "about" refers to a +/−20% variation from the nominal value. It is to be understood that such a variation is always included in a given value provided herein, whether or not it is specifically referred to.

As used herein the term "equivalent" in referring to dimensions of transmission lines or antenna elements allows that these items may be shorter than one quarter wavelength if the structure is so constructed as to cause it to operate as if it were one quarter of a wavelength.

Unless defined otherwise, all technical and scientific terms used herein have the same meaning as commonly understood by one of ordinary skill in the art to which this invention belongs.

The present invention provides a multiple antenna system providing polarization and pattern diversity in a compact structure. The antenna system comprises two or more antennas for transmitting and/or receiving radio frequency energy, and a substantially minimum number of additional features for facilitating a desired radiation pattern at each antenna and optionally for providing electromagnetic isolation between the antennas. The multiple antenna system according to the present invention comprises a first antenna, a second antenna, and a passive element which is operatively coupled to each antenna. The passive element acts as a Balun for the first antenna, and as a passive element electromagnetically coupled to the second antenna. The passive element is configured to absorb and re-radiate, reflect or scatter electromagnetic radiation from the second antenna to produce a desired radiation pattern.

Figure 2:
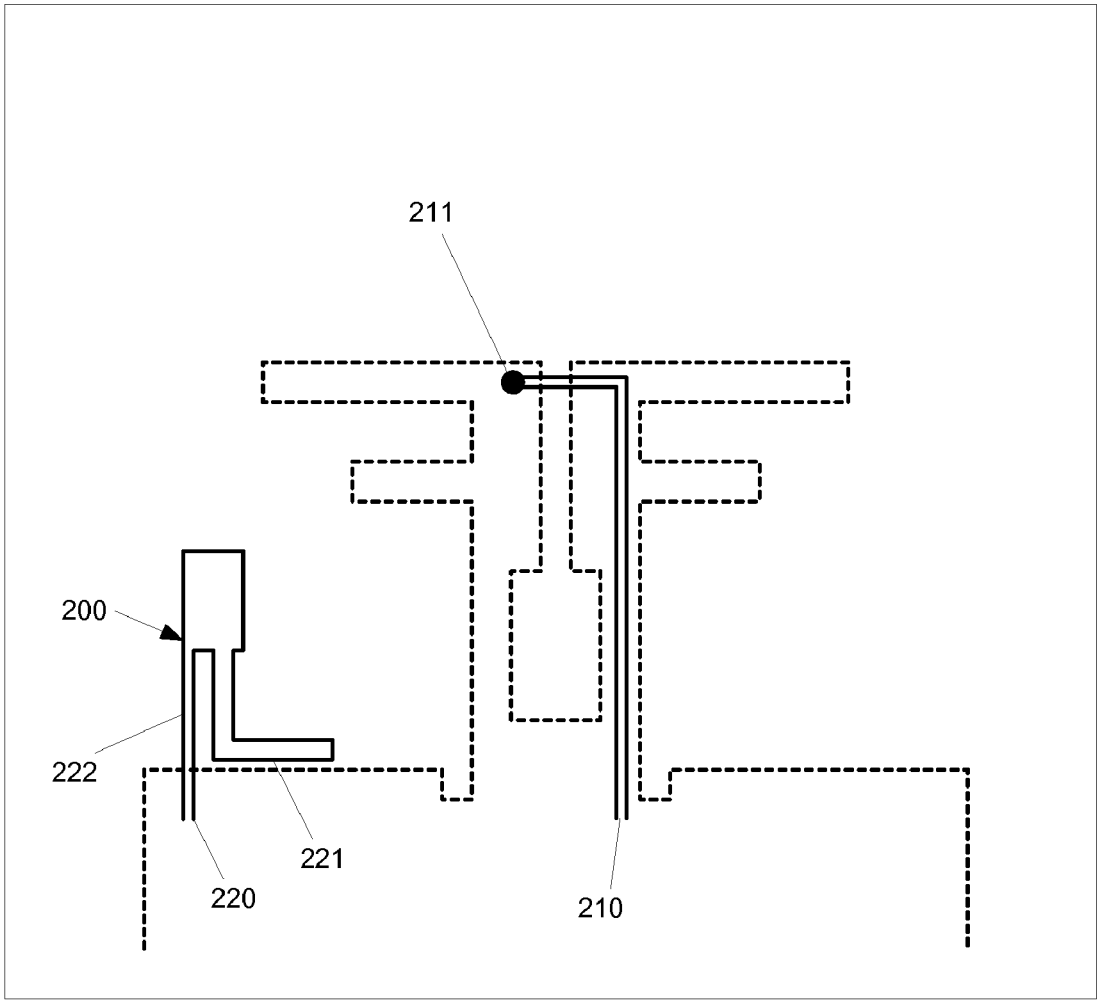
FIG. 2 is a view of the opposite side of the printed circuit board of FIG. 1, showing additional structure of the multiple antenna system.

FIGS. 1 and 2 show a multiple antenna system according to one embodiment of the present invention. The multiple antenna system comprises a first antenna 10 and a second antenna 100, supported by a passive element 80, which acts as a Balun for first antenna 10 in part by virtue of having a gap notch 70, and which is configured to absorb and re-radiate electromagnetic radiation from the second antenna to produce a desired radiation pattern in part by virtue of its placement and orientation.

In one embodiment of the present invention, a substantial ground plane or counterpoise is located adjacent to the antenna system, for example at the bottom end. This ground plane or counterpoise is connected to a host system via such means as a PCMCIA, Express Card, USB interface or other such means.

First Antenna

The multiple antenna system comprises a first antenna, which includes two radiating bodies and operates in conjunction with other radio system components to transmit and/or receive radio frequency energy via electromagnetic radiation. The first antenna can be typically operated in conjunction with an electrically balanced interface between the first antenna and a transmission line connected thereto. For example, a structure providing such an electrically balanced interface is a Balun.

In one embodiment, the first antenna is a center-fed dipole having two radiating bodies, the radiating bodies being separated by a gap. The shape of the radiating bodies is a design variable, and may be of many shapes including but not limited to rectangular, cylindrical, triangular, conical, helical, "T" shaped, "U" shaped, and "F" shaped bodies. Furthermore, additional antenna concepts can include antennas such as the Vivaldi, tapered notch/slot, flaired taper/notch or other such structures. In another embodiment, the first antenna is a loop antenna, having a gap at a point of connection to a transmission line. It is contemplated that an antenna structure which may be operatively coupled at an electrically balanced interface may comprise the first antenna.

Second Antenna

The multiple antenna system further comprises a second antenna, which may be either operational or idle during operation of the first antenna. To provide a desired radiation pattern, the second antenna is operated in conjunction with a passive element configured to absorb and re-radiate electromagnetic radiation from the second antenna. For example, in order to reduce space, complexity, and cost, this passive element shares at least a portion of its structure with the Balun operating in conjunction with the first antenna.

In one embodiment, the purpose of providing a second antenna is to provide antenna diversity. For example, if the second antenna, due to its shape, orientation, position, or operation in conjunction with passive elements or reflective objects, has a polarization substantially different from the first antenna, polarization diversity of the antenna system may be provided. In one embodiment, the first antenna and second antenna are substantially orthogonal. If the second antenna, due to its shape, orientation, position, or operation in conjunction with passive elements or reflective objects, has a radiation pattern or polarization different from the first antenna, pattern diversity may be provided. If the second antenna has a different location than the first antenna, spatial diversity may be provided.

In one embodiment, the purpose of providing a second antenna is to facilitate MIMO (multiple input multiple output communication) or beamforming, as would be readily understood by a worker skilled in the art. For example, communication or signal processing techniques such as spatial multiplexing, space time coding, and phased array communication may be facilitated by the provision of multiple antennas.

In one embodiment, the second antenna comprises a monopole antenna having a single radiating body. The radiating body is situated with respect to a ground plane, an arrangement which can result in a desired radiation pattern. The shape of the radiating body is a design variable, and may be of many shapes including but not limited to rectangular, cylindrical, triangular, conical, helical, "T" shaped, "U" shaped, "F" shaped bodies, and a combination thereof, or other shape as would be readily understood by a worker skilled in the art.

In one embodiment, there is provided an impedance matching means for the second antenna, to ensure efficient connection of the transmission line to the second antenna, which can reduce reflection of radio frequency energy at the connection point (the return loss). Impedance matching can be provided, for example, by providing a desired inductance and a desired capacitance at the interface between the antenna and transmission line by using an appropriately configured inductor and capacitor, or by using distributed matching, or by other impedance matching means using appropriately configured electromagnetically active bodies. Inductance, resistance, and capacitance may be provided in combination of series and/or parallel configurations as would be known in the art. In one embodiment, the impedance matching increases the return loss of the second antenna to greater than 10 dB. Namely, the reflectivity of the interface is reduced to less than −10 dB. In one embodiment, impedance matching is performed so that a nominal 50 Ohm impedance is exhibited by one or more of the antenna elements.

In one embodiment, the antenna system may comprise additional passive elements, such as one or more directors, which are further configured to absorb and re-radiate electromagnetic radiation from the second antenna and the passive element to produce a desired radiation pattern, as known in the art. For example, the arrangement of antenna elements may bear similarities to the Yagi-Uda antenna, log-periodic antenna, an antenna comprising one or more corner reflectors or parabolic reflectors, or a combination thereof.

Passive Element

The multiple antenna system further comprises a passive element which is configured as a Balun for the first antenna, and is also configured to act so as to absorb and re-radiate electromagnetic radiation from the second antenna to produce a desired radiation pattern.

In one embodiment, the Balun functionality of the passive element is achieved by attaching the two bodies of the first antenna to the passive element, and having a notch in the passive element situated in-line with the gap separating the two radiating bodies. As is known in the art, the transmission line may be routed overtop of the passive element and attached to one radiating body. The notch, having for example an effective depth of one quarter of the operating wavelength of the first antenna and having a width less than the depth, may provide a RF energy path between the radiating bodies which results in the first antenna reacting as if to a balanced transmission line.

In one embodiment, the Balun acts to promote electromagnetic isolation of the first antenna from other antennas by virtue of its functionality of transforming between balanced and unbalanced electrical signals. Further isolation may be provided by having conductive projections extending from the passive element of the first antenna, which reflects electromagnetic radiation from the first antenna. These conductive projections may also be configured to absorb and re-radiate electromagnetic radiation from an antenna or set of antennas, so as to produce a desired radiation pattern.

In one embodiment, the passive element, insofar as it absorbs and re-radiates, reflects or scatters electromagnetic radiation from the second antenna, can be described as being a reflector for the second antenna, as known in the art. The reflector may be situated with respect to the same ground plane surface as the second antenna. The height, shape, and relative location of the passive element can be adjusted to trade off reflective capability with size and shape of the reflector. For example, the passive element can be provided with top loading to facilitate a reduction in height as is known in the art. Such top loading may alter the frequency response profile of the passive element, such that it absorbs and re-radiates electromagnetic radiation in a desired manner, while satisfying desired physical dimensional requirements. The passive element may be configured, for example, as a corner reflector, parabolic reflector, or flat reflector.

In one embodiment, the passive element may be physically adjacent to, and electromagnetically coupled with the ground plane, with notches in the ground plane at the point of attachment to improve the operational bandwidth due to the reflector interaction, for example by decreasing the "cut-off" frequency. In one embodiment, the notches decrease the lowermost frequency at which the passive element effectively resonates in response to the second antenna by providing for additional inductance seen by the passive element.

In one embodiment, the passive element operates in conjunction with the second antenna to improve the effective bandwidth over which radio frequency energy may be transmitted or absorbed for radio communication. One method of improving the effective bandwidth is to decrease the "cut-off" frequency of the second antenna. For example, this may be achieved when the spacing between the antenna and the passive element approaches a length effectively equivalent to one quarter of an operating wavelength, such as the wavelength corresponding to a band center frequency.

In one embodiment, the size and displacement of the passive reflector may for example be determined substantially in terms of multiples of eighths of a wavelength of an operating frequency of the antenna system. For example, the passive element may have an effective length of slightly more than one half of an operating wavelength of the second antenna, and the distance between the second antenna and the passive element is substantially one eighth of the operating wavelength, as is known in the art, for example in the Yagi-Uda antenna.

Additional Antennas

In addition to the first and second antennas, the multiple antenna system described herein may comprise one or more additional antennas.

In one embodiment, a transmission line similar to that of the first antenna is continued to an additional transmission line component, said additional transmission line component operatively coupled to an additional ground plane, the additional transmission line also being operatively coupled to an additional antenna lying in the plane of the additional ground plane. Further antenna diversity can be provided by selecting a relative orientation of the additional antenna and additional ground plane with respect to the first and second antenna. In one embodiment, the additional antenna is substantially orthogonal to the first and second antennas, thereby providing polarization diversity. The additional antenna is provided having at least one radiating body, with a portion of this radiating body configured to act as a wave trap for the continued portion of the transmission line. In one embodiment, the portion of the transmission line, of a microstrip or a stripline nature, between the first antenna and the additional antenna is electrically coupled at a first end to one half of the balanced interface of the first antenna, and passes through the provided wave trap to connect at a second end to the third antenna at an appropriate location. In one embodiment, the additional antenna is a dipole, with one radiating body or counterpoise having a "U" shape, the cavity of the "U" being of length substantially equal to one quarter of an operating wavelength. The continued portion of the transmission line, microstrip or stripline, passes between the arms of the "U" shaped body, which effectively electromagnetically isolates the additional antenna from the first antenna.

In a further embodiment, the transmission line between the first antenna and the additional antenna comprises a stripline with a ground component connected directly to one side of the balanced interface of the first antenna. This connection is a "Quasi ground point". While it may seem at first glance that such a connection would load or impact the first antenna this is not the case. Instead, the "U" shaped counterpoise acts as a wave trap around the transmission line between the first and second antenna, causing the external ground of the transmission line to present a high impedance to the first antenna. Since the transmission line operatively coupled to the first antenna is at a relatively low impedance, it is unaffected by the high impedance nature of the additional transmission line at the attachment point. In one embodiment, the wave trap is a "U" shaped quarter wave trap which prevents energy of a frequency relevant to the first antenna from flowing down the stripline. The stripline passes over one side of the passive element supporting the first antenna to operatively couple with a modem or other radio device.

In one embodiment, the additional antenna is a center fed dipole driven at its open center with a stripline center conductor. The top of the antenna is a top loaded "T" shaped element, while the counterpoise is a "U" shaped wave trap.

In one embodiment, the first antenna is housed on a first circuit board, and an additional antenna is part of a separate structure which may be oriented out of the plane of the first circuit board. In one embodiment, the additional antenna is housed on a second circuit board, which may be movably folded out of the plane of the first circuit board for operation, for example substantially orthogonal to thereto, and folded against the first circuit board when not in use.

In one embodiment, an additional antenna is provided such that the common, passive element is located between the second antenna and the additional antenna. The passive element is configured to absorb and re-radiate electromagnetic radiation from each of the second antenna and the additional antenna to produce desired radiation patterns for each antenna. It is to be appreciated that the passive element may also provide electromagnetic isolation between the second antenna and the additional antenna in this case due to its location between the two antennas. The use of a common element as a supporting electromagnetic structure for two antennas allows for a reduction in size and complexity of the antenna system. In a symmetric version of this embodiment, the second antenna and the additional antenna are co-polarized, and both the antenna system and its combined radiation pattern are symmetric about an axis through the centre of the passive element.

In one embodiment, the Balun structure of the passive element causes electrical current to circulate around the Balun gap in accordance with the Balun operation with respect to the first antenna. However, currents on either side of the gap are substantially equal and opposite in direction, and therefore effectively cancel each other when viewed from the outside. Hence, operation of the passive element as it pertains to the second antenna and additional antenna, for example as a reflector or parasitic element, is unaffected by these circulating currents.

In one embodiment, the isolation between the first antenna and an additional antenna, as provided by the passive element, is greater than 10 dB.

It is to be understood that the antennas comprising the multiple antenna system described herein may be operated simultaneously or at separate times, depending on how the provided antenna diversity is to be exploited. To this end, switches, such as diodes, transistors or GASFETs, may be included for the purpose of disabling some antennas, for example a switch may be placed in series with the transmission line between the first and additional antenna which may be operated to disable the additional antenna or bypass the first antenna. Switches may furthermore be included to selectably operatively couple additional passive elements to a selected antenna. For example switches may allow controllable coupling of a selected antenna to resonators, capacitative, inductive or resistive structures, or parasitic elements in order to vary the characteristics of the selected antenna, for example the operating frequency, gain, cutoff frequency, or bandwidth.

In one embodiment, the operating frequency of all antennas is between 2.3 and 3.8 GHz. Consequently, the operating wavelength is between 80 and 130 millimeters in free space. Scaling to other operating frequencies is obvious to those versed in the art.

In one embodiment, the antenna system is directed to use in Wi-Max communication. The antenna system may be built into a laptop, cell phone, or supporting device such as a PCMCIA card, an Express card, a USB modem or an external unit, or may be provided in another manner as would be readily understood by a worker skilled in the art.

Other applications for the antenna system would be known by one skilled in the art. For example, the antenna system could be directed for use in GSM, CDMA, UMTS, or other communication system. The antenna system may provide a convenient small form factor for application in such systems.

The invention will now be described with reference to specific examples. It will be understood that the following examples are intended to describe embodiments of the invention and are not intended to limit the invention in any way.

EXAMPLES

Example 1

The following examples are directed towards compact diversity antenna systems, and thus examples herein are directed toward compact design technology. In particular, these examples feature printed circuit board antenna designs, which are known in the art and are used for many applications as they are compact, economical, and easy to manufacture. It is obvious to a worker skilled in the art that other means, such as lengths of wire and coaxial cable, could also be used in construction of a multiple antenna system according to an embodiment of the present invention.

With reference to FIGS. 1 and 2, one embodiment of the present invention is illustrated having two antennas. FIG. 1 illustrates one layer of a printed circuit board having the following features comprising part of the present invention in accordance with Example 1. A first antenna 10 is depicted as a simple dipole comprising two radiating bodies 20 and 30, the radiating bodies separated by a gap 40. The first antenna 10 is polarized in a direction parallel to the surface 51 of a ground plane 50, the first antenna 10 being offset from the ground plane 50. A passive element 60, physically and electrically connected to ground plane 50, extends perpendicular from surface 51 toward the first antenna 10 and connects physically and electrically with first antenna 10 at location 81 for radiating body 20, and location 91 for radiating body 30. These physical and electrical connections comprise an operative coupling between the first antenna 10 and the passive element 60. A notch 70 is present in the passive element 60, the notch 70 being aligned with the gap 40 and extending from the first antenna 10 toward the ground plane 50. The notch 70 splits passive element 60 into portions 80 and 90, which terminate in the radiating bodies 20 and 30, at locations 81 and 91, respectively. The purpose of notch 70 is to separate radiating bodies 20 and 30, such that the shortest electrical path between radiating bodies 20 and 30 is defined by the perimeter of notch 70. By dimensioning notch 70 so that its depth L1 71 is substantially equal to one quarter of the operating wavelength of first antenna 10, passive element 60 can be made to comprise a Balun for first antenna 10 when connected to a transmission line as detailed in FIG. 2. In order to provide for shortening the depth L1 71, the notch 70 can be widened to provide increased shunt inductance. Additionally, the gap 40 may be narrowed to provide increased shunt capacitance, particularly when the gap width decreases below the PCB thickness. These two effects can independently or collectively decrease the resonant frequency of the notch 70. Alternatively the resonant frequency can be kept constant and the depth L1 71 can be decreased allowing for a shorter and therefore a more compact passive element geometry. Finally the RF feed to the first antenna 10 will originate from the RF system at location 125.

Continuing with reference to FIG. 1, a second antenna 100 is depicted, being a monopole with a single radiating body 110 operating in conjunction with ground plane 50, as is known in the art. As is also known in the art, distributed impedance matching, comprising series inductor 120 and portion of shunt capacitor 130, is provided to optimize signal connection to second antenna 100. Series inductor 120 provides an inductive electrical path from second antenna 100 to the RF feed 115, whereas the shunt capacitor 130 provides a capacitative electrical path between second antenna 100 and the ground plane 50 as detailed in FIG. 2. Radiating body 110 is placed in a spaced-apart configuration with passive element 60, at a distance that allows passive element 60 to absorb and re-radiate electromagnetic radiation from second antenna 100 to produce a desired radiation pattern. In particular, passive element 60 acts as a reflector or scatterer as is known in the art, and also reduces the electromagnetic radiation due to second antenna 100 on the far side of passive element 60, in space 140. In the current embodiment, ground plane 50 has notches 52 and 53 at the base of passive element 60, which serve to decrease the lowest operating frequency (cut-off) of the antenna system comprising second antenna 100 and passive element 60. Furthermore, passive element 60 has top loading bodies 82 and 92 extending outward from element portions 80 and 90, respectively. The purpose of top loading bodies 82 and 92 is to allow passive element 60 to resonate with electromagnetic radiation in the correct frequency range so as to absorb and re-radiate electromagnetic radiation from second antenna 100 as desired. The use of top loading bodies 82 and 92 allows for a shorter overall height of passive element 60.

FIG. 2 shows a second layer of the printed circuit board depicted in FIG. 1 having features comprising part of the present invention in accordance with Example 1. For convenience the features depicted in FIG. 1 are represented by dashed lines in FIG. 2 to provide relative location reference. FIGS. 1 and 2 together represent the complete exemplified antenna system. Referring to FIG. 2, a microstrip conductor 210 is provided for first antenna 10, electrically connected at location 211 to radiating body 20 by an inter-surface electrical connection such as a via. Microstrip conductor 210 passes overtop of passive element 60 and in particular overtop of passive element portion 90, the combination of microstrip conductor 210 and passive element 60, and microstrip conductor 210 and passive element portion 90 together comprising a transmission line, as is known in the art. By symmetry, it is clear that alternatively microstrip conductor 210 could pass overtop of passive element portion 80 and connect to radiating body 30 at an alternative location 212. The Balun structure causes first antenna 10 to see a balanced transmission line with terminal points at locations 211 or 212 as determined by the chosen connection.

Continuing with reference to FIG. 2, a microstrip conductor 220 is provided for connection to series inductor 120/222, terminating in the lower portion of antenna 200, so as to provide a series inductive coupling of microstrip conductor 220 to second antenna 100/200. Shunt capacitance 221 between the antenna 100/200 and the ground plane 50 further provides for the shunt matching requirements. Thus second antenna 100/200 is provided with a transmission line for connection with other radio system components. This simple two element distributed match may be realized with discrete components or in other ways obvious to one versed in the art.

Example 2

Figure 3:
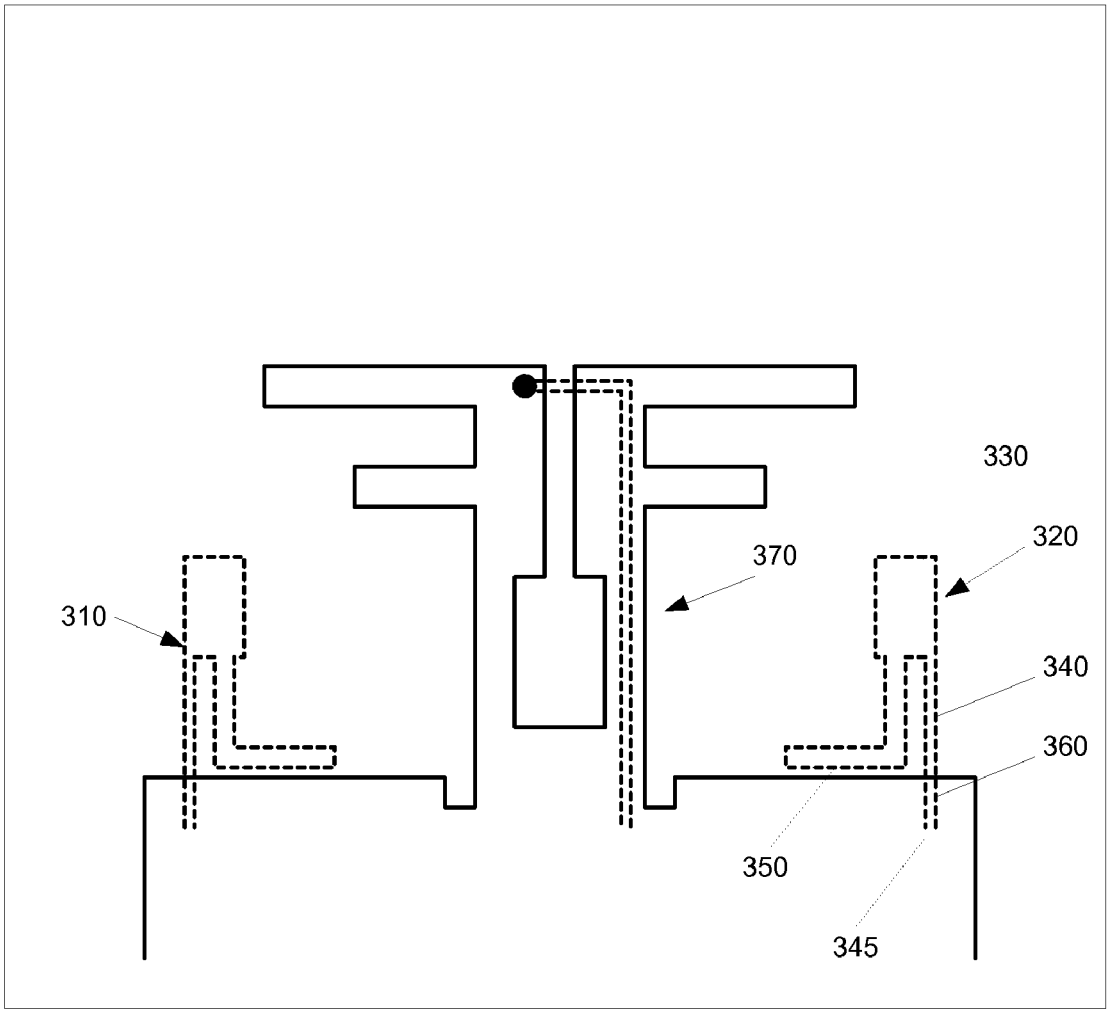
FIG. 3 is a view of one side of a printed circuit board comprising a multiple antenna system according to another embodiment of the present invention.

FIG. 3 depicts two sides of a printed circuit board in a second example embodiment, being an extension to the embodiment of Example 1, wherein a second monopole antenna 320 is placed on the opposite side of the passive element 370 of the first monopole antenna 310. The second monopole antenna 320 operates analogously to the first monopole antenna 310 in Example 1, and comprises a radiating body 330, a series inductor 340 that connects from this body 330 to the transmission line 360, and shunt capacitor 350 coupling this second monopole antenna 330 to the ground plane 50. Second monopole antenna 320 is placed in a spaced-apart configuration with passive element 370, at a distance that allows passive element 370 to absorb and re-radiate electromagnetic radiation from second monopole antenna 320 to produce a desired radiation pattern. In particular, passive element 370 acts as a reflector as is known in the art, and also reduces the electromagnetic radiation seen by first monopole antenna 310 due to second monopole antenna 320, and the electromagnetic radiation seen by second monopole antenna 320 due to first monopole antenna 310. Also illustrated is the RF feed 345 for the second monopole antenna 320. The rest of the antenna system operates similarly to Example 1. The second side of the printed circuit board is not shown but corresponds to the dashed lines in FIG. 3.

Example 3

Figure 4:
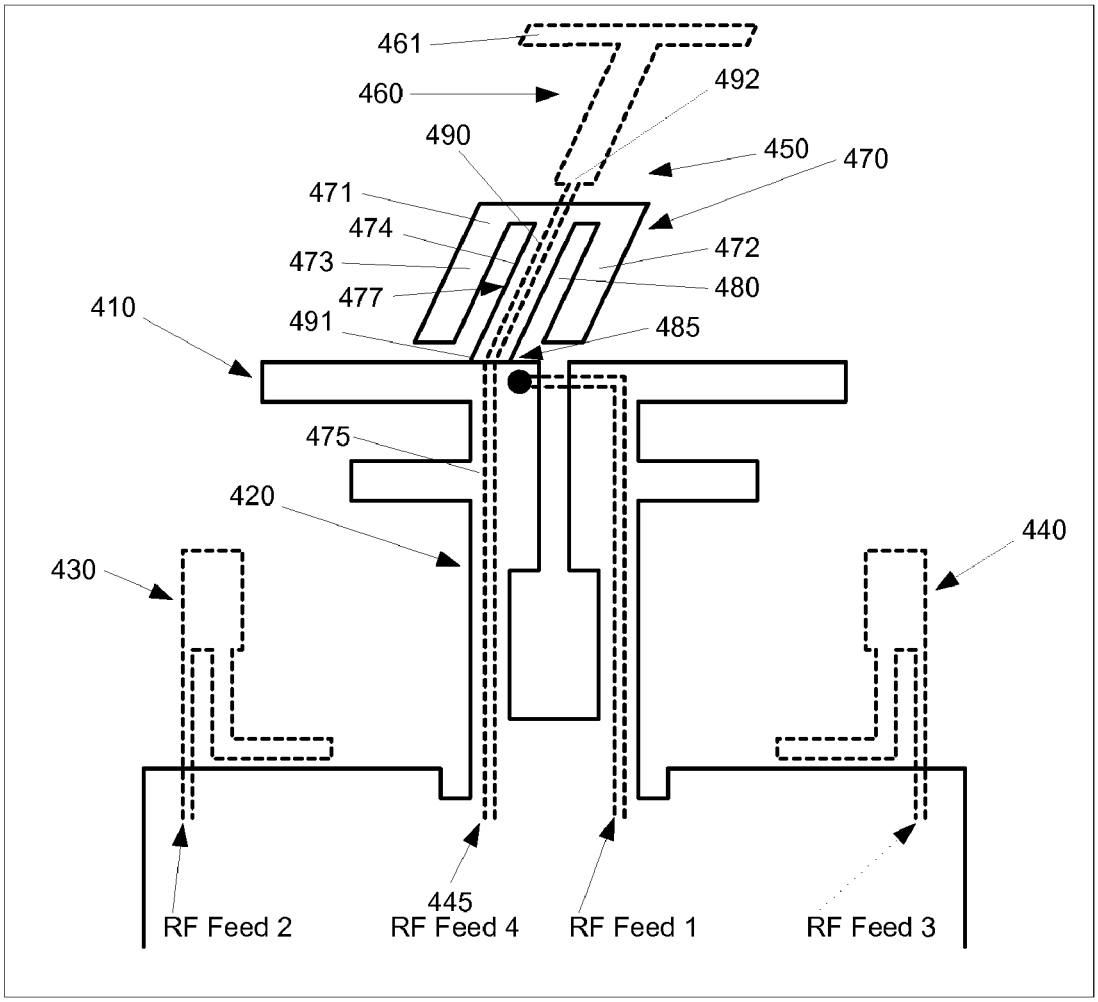
FIG. 4 is a view of one side of a printed circuit board comprising a multiple antenna system according to another embodiment of the present invention.
Figure 5:
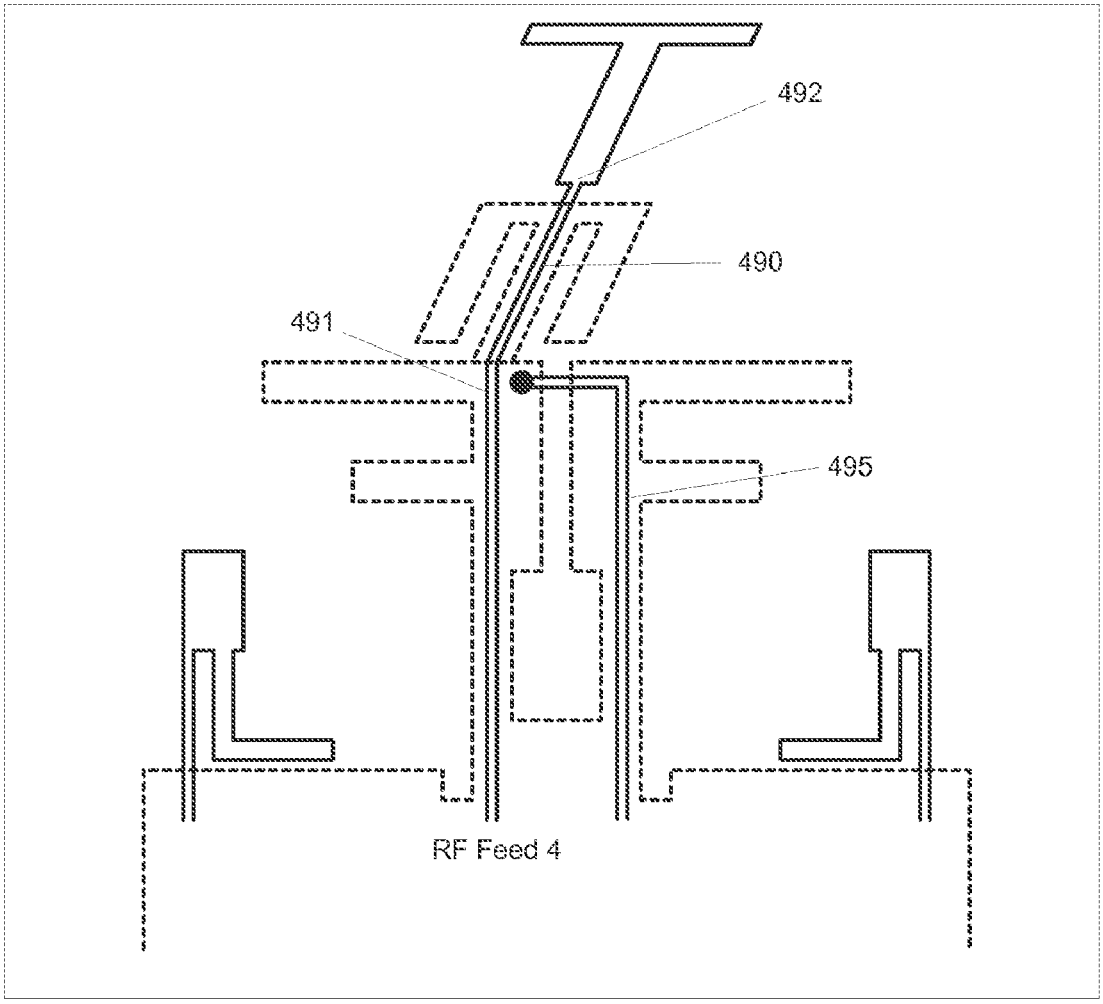
FIG. 5 is a view of the opposite side of the printed circuit board of FIG. 4, showing additional structure of the multiple antenna system.

FIGS. 4 and 5 depict two sides of a printed circuit board in a third example embodiment, being an extension to the example embodiment of Example 2, wherein an additional dipole antenna 450 is provided extending, at substantially right angles at the 90 degree fold 485, out of the plane containing the antenna elements of Example 2: the first dipole antenna 410, passive element 420, second monopole antenna 430 and additional monopole antenna 440. This second dipole 450 is effectively orthogonal to all the other coplanar antennas. The additional dipole antenna 450 comprises a first radiating body 460, with top loading portion 461 added to allow for a reduction in length requirements, and a second radiating body 470. The second radiating body 470 further comprises a connecting portion 471, a first arm 472, and a second arm 473, defining a cavity 480. The ground plane 474 of the microstrip transmission line 477 is connected at a first end 491 to one radiating body of the first dipole antenna 410 at the fold point 485. The microstrip part 490 of the transmission line 477 is connected at a first end 492 to the radiating body 460 and at a second end to the microstrip 475. The practice of running the microstrip transmission line 490 through cavity 480 causes the cavity 480 and surrounding structure to act as a quarter wave trap which prevents RF energy flowing down the microstrip transmission line 490 from the additional dipole antenna 450. Consequently, the first dipole antenna 410 sees a high impedance connection at first end 491, so that the additional dipole antenna 450 does not represent a heavy electrical load at that point.

In one embodiment, conductor 490 is operatively coupled with first arm 472 and second arm 473 to form a stripline transmission line.

In one embodiment, first arm 472 and second arm 473 comprise a counterpoise for the second dipole antenna 450.

This system describes an embodiment comprising four orthogonal antennas: two dipoles and two monopoles. As illustrated in FIG. 4, the first dipole antenna 410 is fed via RF feed 1, the first monopole antenna 430 is fed via RF feed 2 and the second monopole antenna 440 is fed via RF feed 3 and finally the second orthogonal dipole antenna 450 is fed via RF feed 4, 445.

Example 4

Figure 6:
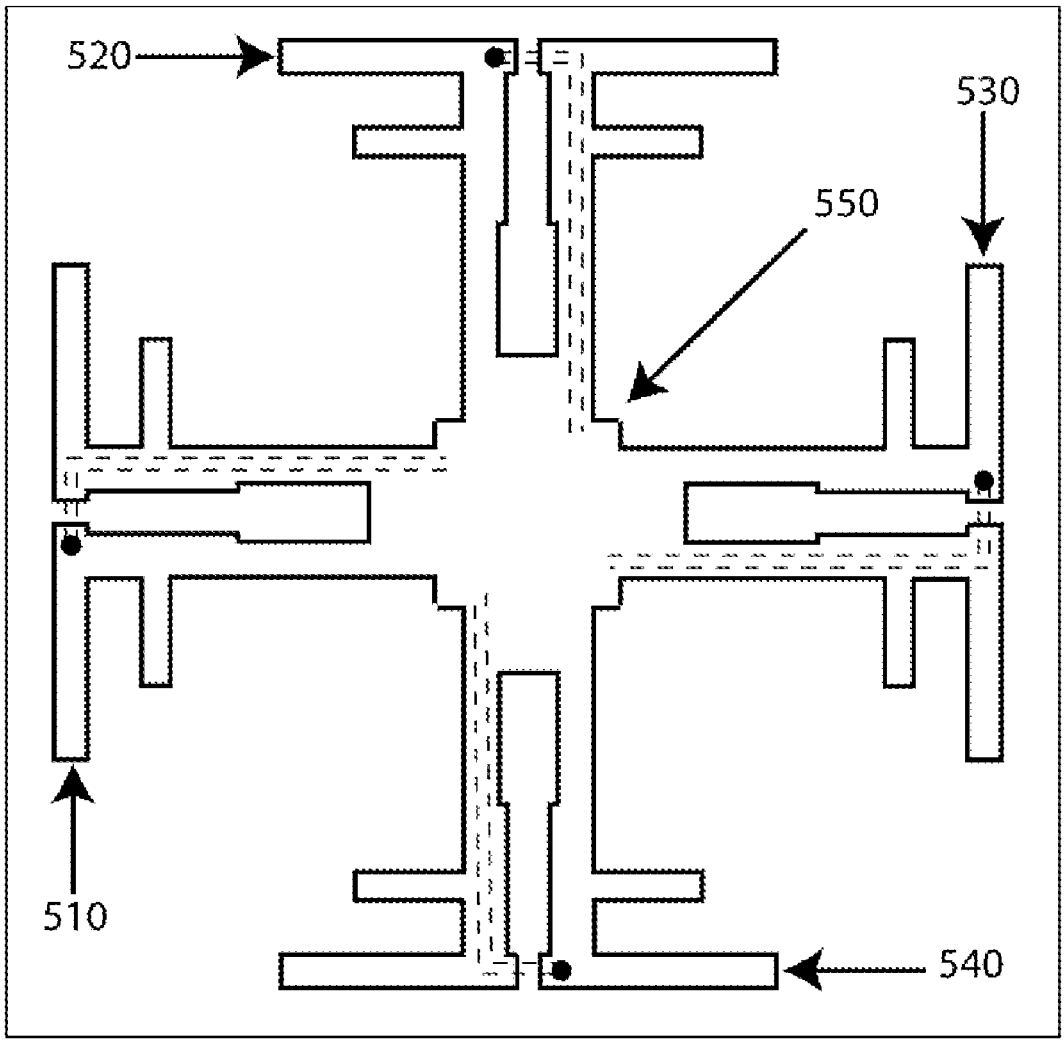
FIG. 6 is a view of one side of a printed circuit board comprising a multiple antenna system according to another embodiment of the present invention.

FIG. 6 depicts an alternative embodiment of the invention, comprising four dipole antennas 510, 520, 530, and 540 arranged around a central passive element 550. The central passive structure operates as a Balun for each dipole antenna, and is also configured to absorb and re-radiate electromagnetic radiation from each antenna to provide a desired radiation pattern. Note that the dimensions of each antenna, and each Balun structure, need not be identical. This allows for antennas of different operating frequencies if desired, in addition to polarization and pattern diversity.

In the foregoing embodiments, no references were made to absolute size of the antenna system elements. It is known to one skilled in the art that the size of the elements is directly linked to the operating frequency of the antenna system, and that the entire structure can be conveniently scaled up or down to accommodate different frequencies.

It is obvious that the foregoing embodiments of the invention are examples and can be varied in many ways. Such present or future variations are not to be regarded as a departure from the spirit and scope of the invention, and all such modifications as would be obvious to one skilled in the art are intended to be included within the scope of the following claims.

We claim:

1. A multiple antenna system comprising:

a) a first antenna having two radiating bodies;

b) a second antenna; and c) a passive element operatively coupled to the first antenna, the passive element configured as a Balun for the first antenna, the passive element configured, at least in part due to placement thereof, to absorb and re-radiate electromagnetic radiation from the second antenna to produce a desired radiation pattern.

2. The multiple antenna system according to claim 1, wherein the passive element is further configured to provide electromagnetic isolation between the first antenna and the second antenna.

3. The multiple antenna system according to claim 1, wherein the first antenna is a center-fed dipole antenna.

4. The multiple antenna system according to claim 1, wherein the first antenna is operated substantially simultaneously as the second antenna.

5. The multiple antenna system according to claim 1, wherein the first antenna has a first radiation pattern and the second antenna has a second radiation pattern, the first radiation pattern being substantially different from the second radiation pattern.

6. The multiple antenna system according to claim 1, further comprising a third antenna having a third radiating body, a portion of the third radiating body configured to act as a wave trap for a transmission line coupled to the third antenna, the transmission line connected at a first end to one of the two radiating bodies of the first antenna and passing through the wave trap to connect at a second end to the third antenna.

7. The multiple antenna system according to claim 1, further comprising one or more directors configured to absorb and re-radiate electromagnetic radiation from the second antenna and the passive element to produce a desired radiation pattern.

8. The multiple antenna system according to claim 1, further comprising a third antenna, the passive element positioned between the second antenna and the third antenna, the passive element configured to absorb and re-radiate electromagnetic radiation from the third antenna to produce a desired radiation pattern.

9. The multiple antenna system according to claim 8, wherein the first antenna has a first polarization and the third antenna has a third polarization, the first polarization being substantially same to the third polarization.

10. The multiple antenna system according to claim 1, wherein the two radiating bodies of the first antenna are separated by a gap, the passive element including connections to the two radiating bodies of the first antenna, the passive element further including a notch between the connections to the two radiating bodies, said notch substantially in line with the gap.

11. The multiple antenna system according to claim 10, wherein the first antenna has an operating wavelength, and the notch has a depth and a width, the depth being substantially equivalent to one quarter of the operating wavelength, and the width being less than the depth.

12. The multiple antenna system according to claim 1, wherein the each of the two radiating bodies of the first antenna have a shape selected from the group comprising: rectangular, cylindrical, triangular, conical, helical, T shaped, U shaped and F shaped.

13. The multiple antenna system according to claim 1, wherein the second antenna is a monopole antenna including a single radiating body having a shape selected from the group comprising: rectangular, cylindrical, triangular, conical, helical, T shaped, U shaped and F shaped.

14. The multiple antenna system according to claim 1, wherein the first antenna is housed on a first circuit board and the second antenna is housed on a second circuit board, said second circuit board foldably coupled to the first circuit board, wherein said second circuit board is foldable out of a plane of the first circuit board.

15. The multiple antenna system according to claim 14, wherein the second circuit board is reversibly foldable between a substantially perpendicular orientation with the first circuit board and a substantially parallel orientation with the first circuit board.

16. A multiple antenna system comprising:

a) a first antenna having two radiating bodies;

b) a second antenna;

c) a passive element operatively coupled to the first antenna, the passive element configured as a Balun for the first antenna, the passive element configured to absorb and re-radiate electromagnetic radiation from the second antenna to produce a desired radiation pattern; and d) a first switch operatively coupled to the first antenna, and a second switch operatively coupled to the second antenna, the first switch and the second switch independently operable, wherein the first switch disables or enables operation of the first antenna and the second switch disables or enables operation of the second antenna.

17. The multiple antenna system according to claim 16, wherein the first switch or the second switch is a diode, transistor or a GASFET.

18. The multiple antenna system according to claim 16, wherein the first switch is configured to operatively couple first antenna to a resonator, inductive structure, resistive structure or a parasitic element.

19. The multiple antenna system according to claim 16, wherein the second switch is configured to operatively couple second antenna to a resonator, inductive structure, resistive structure or a parasitic element.

20. A multiple antenna system comprising:

a) a first antenna having two radiating bodies;

b) a second antenna; and c) a passive element operatively coupled to the first antenna, the passive element configured as a Balun for the first antenna, the passive element configured to absorb and re-radiate electromagnetic radiation from the second antenna to produce a desired radiation pattern, wherein the first antenna has a first polarization and the second antenna has a second polarization, the first polarization being substantially different from the second polarization.

21. A multiple antenna system comprising:

a) a first antenna having two radiating bodies;

b) a second antenna; and c) a passive element operatively coupled to the first antenna, the passive element configured as a Balun for the first antenna, the passive element configured to absorb and re-radiate electromagnetic radiation from the second antenna to produce a desired radiation pattern, wherein the second antenna is a monopole antenna situated with respect to a ground plane to produce a desired radiation pattern.

22. The multiple antenna system according to claim 21, wherein the passive element contacts the ground plane along an edge of contact, the ground plane further having a first notch and a second notch with the edge of contact situated therebetween.

23. The multiple antenna system according to claim 21, wherein the ground plane is connected to a host system via a PCMCIA Express Card or a USB interface.

24. A multiple antenna system comprising:

a) a first antenna having two radiating bodies;

b) a second antenna; and c) a passive element operatively coupled to the first antenna, the passive element configured as a Balun for the first antenna, the passive element configured to absorb and re-radiate electromagnetic radiation from the second antenna to produce a desired radiation pattern; and d) an impedance matching structure having a capacitance and an inductance, the impedance matching structure configured to provide impedance matching between the second antenna and a transmission line operatively coupled thereto.

25. The multiple antenna system according to claim 24, wherein the impedance matching structure affects a return loss between the second antenna and the transmission line, the return loss being less than 10 dB.

* * * * *